US006757992B1

(12) United States Patent
Berger et al.

(10) Patent No.: US 6,757,992 B1
(45) Date of Patent: Jul. 6, 2004

(54) SKID STEER LOADER BUCKET SHAKER

(75) Inventors: John G. Berger, Landisville, PA (US); John R. Haupt, Lititz, PA (US)

(73) Assignee: New Holland North America, Inc., New Holland, PA (US)

( * ) Notice: Subject to any disclaimer, the term of this patent is extended or adjusted under 35 U.S.C. 154(b) by 0 days.

(21) Appl. No.: 10/341,369

(22) Filed: Jan. 14, 2003

(51) Int. Cl.[7] ..... E02F 5/02
(52) U.S. Cl. ..... 37/348; 37/904; 701/50
(58) Field of Search ..... 37/343, 382, 903, 37/904; 404/117; 701/50; 60/420, 426; 172/1, 2, 10; 414/699, 694, 700; 175/24, 27, 1

(56) References Cited

U.S. PATENT DOCUMENTS

| | | | |
|---|---|---|---|
| 3,084,817 | A | 4/1963 | Lovrenich |
| 3,677,426 | A | 7/1972 | Luck |
| 4,537,556 | A | 8/1985 | Tharp |
| 4,679,337 | A | 7/1987 | Carternock et al. |
| 4,698,925 | A | 10/1987 | Jones et al. |
| 4,871,044 | A | 10/1989 | Strosser et al. |
| 5,160,034 | A | 11/1992 | Potter |
| 5,172,498 | A | 12/1992 | Wack |
| 5,224,033 | A | 6/1993 | Nakamura et al. |
| 5,495,685 | A | 3/1996 | Labutin et al. |
| 5,860,231 | A | 1/1999 | Lee et al. |
| 6,360,459 | B1 | 3/2002 | Brookhart et al. |
| 6,371,214 | B1 | 4/2002 | Anwar et al. |

*Primary Examiner*—Robert E. Pezzuto
(74) *Attorney, Agent, or Firm*—John William Stader; Collin A. Webb

(57) ABSTRACT

A work vehicle having an implement, including: a frame; a boom arm assembly connected at one end to the frame; an implement assembly pivotally connected to another end of the boom arm assembly and including the implement; a first hydraulic implement cylinder connected to the implement assembly and positioned to pivotally rotate the implement relative to the boom arm assembly when a piston of the first implement cylinder is extended or retracted, the first hydraulic implement cylinder being connected to a first electrohydraulic valve for activating extension and retraction of the piston of the first implement cylinder; and a controller connected to send control signals to activate the first electrohydraulic valve, wherein the controller sends a series of shaking control signals to alternately extend and retract the first implement cylinder to effect a shaking movement of the implement.

19 Claims, 4 Drawing Sheets

SKID STEER LOADER BUCKET SHAKER

FIELD OF THE INVENTION

The present invention pertains generally to a work vehicle that has a bucket, such as a skid steer loader, and, more particularly to a work vehicle with a bucket shaker to dislodge material from the bucket, if necessary. More particularly, the present invention relates to an improved work vehicle that includes a mechanism for dislodging material from the bucket that provides automatic bucket shaking under the control of an on board computer or microprocessor.

BACKGROUND OF THE INVENTION

Skid steer loaders (also known as "skidders") are work vehicles that include four wheels rotatably mounted to a frame, an engine mounted on the frame and connected by a transmission to rotate at least two wheels, a cab compartment mounted on the frame that includes a seat for an operator, manual controls and a display panel disposed in the cab compartment, a boom assembly rotatably mounted on the frame and connected to a pair of hydraulic boom cylinders for moving the boom assembly, and an implement assembly connected to the boom assembly. Typically, one or more hydraulic cylinders are used to manipulate the implement assembly. Preferably, the implement assembly is a bucket assembly, wherein the implement is a bucket and a pair of hydraulic bucket cylinders is used to move the bucket assembly. Other types of work vehicles that are similar to skid steer loaders include tractors and bulldozers.

When a skidder is equipped with a loader bucket, the work vehicle is primarily used for digging. One issue that arises during digging operations is that dumping of dirt and other potentially sticky materials such as manure, fertilizers, sand, and the like, from the loader bucket may be incomplete, leaving behind a residue. Consequently, some materials can remain stuck to the inside of the loader bucket. Typically, the operator of the skidder will manipulate the manual controls in the cab compartment to "shake" the loader bucket to assist any material residue to jar loose and fall out of the bucket. This operation entails rapidly moving the manual controls in a reciprocating manner to effect shaking of the bucket. Several problems emerge when shaking is attempted in the above manner. First, the amount of shaking the operator can achieve is limited to the human ability to reciprocate the manual controls to effect a shake. This means that the reciprocating movements have a relatively low frequency and generally a large magnitude so that the shake is suboptimal and it may take some amount of shaking to dislodge sticky material from the loader bucket. Second, the hydraulic circuit of the work vehicle generally includes a valve stack for activating movement of the boom assembly and loader bucket; however, the various solenoid activated spool valves used are relatively sluggish because they respond to analog signals, thereby placing a limitation on the capacity of the hydraulic circuit to shake the boom assembly and loader bucket. Third, such rapid manipulation of the manual controls may overstress the manual controls and render them prone to damage.

To operate the hydraulic boom cylinders and the hydraulic bucket cylinders, an operator in the cab manipulates either hand or foot controls. The skid steer loader, or similar work vehicle, includes an electronic control circuit system that includes an onboard computer, microprocessor, or controller. For the purposes of this disclosure, a computer, microprocessor, or controller are considered to be equivalent and interchangeable elements. The onboard computer operates solenoids of electrohydraulic valves that activate the hydraulic boom and the hydraulic bucket cylinders.

U.S. patent application Publication US 2001/0007087 A1 to Brandt et al., which is incorporated herein by reference for all that it discloses, teaches a computer based control system for a skid steer loader that includes a computer receiving inputs from a control panel, various sensors, hand grip and foot pedal inputs, and a seat bar sensor. The computer generates outputs to hydraulic actuators and associated valves, and to electromechanical devices.

An object of the present invention is to provide an improved electronic control system for a work vehicle, or like machine, having a boom assembly and a loader bucket implement assembly connected to the boom assembly so that the improved electronic control system of the present invention maintains the benefits of the prior art electronic control systems while overcoming at least some of the drawbacks of these prior art control systems.

SUMMARY OF THE INVENTION

In accordance with the above objectives, the present invention provides, in a first embodiment, a work vehicle having an implement with: (a) a frame; (b) a boom arm assembly connected at one end to the frame; (c) an implement assembly pivotally connected to another end of the boom arm assembly and including the implement; (d) a first hydraulic implement cylinder connected to the implement assembly and positioned to pivotally rotate the implement relative to the boom arm assembly when a piston of the first implement cylinder is extended or retracted, the first hydraulic implement cylinder being connected to a first electrohydraulic valve for activating extension and retraction of the piston of the first implement cylinder; and (e) a controller connected to send control signals to activate the first electrohydraulic valve, wherein the controller sends a series of shaking control signals to alternately extend and retract the first implement cylinder to effect a shaking movement of the implement.

In accordance with a second embodiment of the invention, the first embodiment is modified so that the controller operates in a first operational mode and in a second operational mode, wherein the controller generates and sends a first series of control signals to the first electrohydraulic valve when operating in the first operational mode and the controller generates and sends the series of shaking control signals when operating in the second operational mode.

In accordance with a third embodiment of the invention, the second embodiment is modified to include a shaking mode activation switch connected to send a command signal to the controller, wherein when the activation switch is engaged the activation switch sends the command signal to the controller and the controller operates in the second mode so long as the controller receives the command signal from the activation switch.

In accordance with a fourth embodiment of the invention, the first embodiment is modified so that the first electrohydraulic valve is a cartridge valve having at least one digital coil, and the at least one digital coil is connected to receive control signals from the controller.

In accordance with a fifth embodiment of the invention, the first embodiment is modified to include a second hydraulic implement cylinder connected to the implement assembly and positioned to pivotally rotate the implement relative to the boom arm assembly when a piston of the second implement cylinder is extended or retracted, the second hydraulic implement cylinder being connected to the first electrohydraulic valve for activating extension and retraction of the piston of the second implement cylinder and the piston of the first implement cylinder, wherein the controller sends a series of shaking control signals to alternately extend and retract the first implement cylinder and the second implement cylinder to effect a shaking movement of the implement.

In accordance with a sixth embodiment of the invention, the first embodiment is modified to include a second hydraulic boom cylinder connected to the boom arm assembly and positioned to move the boom arm assembly relative to the frame of the work vehicle when a piston of the second boom cylinder is extended or retracted, the second hydraulic boom cylinder being connected to a second electrohydraulic valve for activating extension and retraction of the piston of the second boom cylinder, and the controller is connected to send control signals to activate the second electrohydraulic valve, wherein the controller sends control signals to effect movement of the boom assembly.

In accordance with a seventh embodiment of the invention, the sixth embodiment is modified so that the second electrohydraulic valve is a cartridge valve having at least one digital coil, and the at least one digital coil is connected to receive control signals from the controller.

In an eighth embodiment in accordance with the present invention, the first embodiment is modified so that the implement is a loader bucket.

In an ninth embodiment in accordance with the present invention, a work vehicle having an implement comprising: (a) a frame; (b) a boom arm assembly connected at one end to the frame; (c) an implement assembly pivotally connected to another end of the boom arm assembly and including the implement; (d) a first hydraulic boom cylinder connected to the boom arm assembly and positioned to move the boom arm assembly relative to the frame of the work vehicle when a piston of the first boom cylinder is extended or retracted, the first hydraulic boom cylinder being connected to a first electrohydraulic valve for activating extension and retraction of the piston of the first boom cylinder; (e) a first hydraulic implement cylinder connected to the implement assembly and positioned to pivotally rotate the implement relative to the boom arm assembly when a piston of the first implement cylinder is extended or retracted, the first hydraulic implement cylinder being connected to a second electrohydraulic valve for activating extension and retraction of the piston of the first implement cylinder; and (f) a controller connected to send control signals to activate the first electrohydraulic valve and the second electrohydraulic valve, wherein the controller sends a series of shaking control signals to alternately extend and retract one of the first implement cylinder and the first boom cylinder to effect a shaking movement of either the implement or the boom arm assembly and the implement.

In accordance with a tenth embodiment of the invention, the ninth embodiment is modified so the controller operates in a first operational mode and in a second operational mode, wherein the controller generates and sends a first series of control signals to the first electrohydraulic valve and the second electrohydraulic valve when operating in the first operational mode and the controller generates and sends the series of shaking control signals when operating in the second operational mode.

In accordance with an eleventh embodiment of the invention, the tenth embodiment is further modified to include a shaking mode activation switch connected to send a command signal to the controller, wherein when the activation switch is engaged the activation switch sends the command signal to the controller and the controller operates in the second mode so long as the controller receives the command signal from the activation switch.

In accordance with a twelfth embodiment of the invention, the ninth embodiment is modified so each of the first electrohydraulic valve and the second electrohydraulic valve is a cartridge valve having at least one digital coil, and the at least one digital coil is connected to receive control signals from the controller.

In accordance with a thirteenth embodiment of the invention, the ninth embodiment is further modified to include a second hydraulic implement cylinder connected to the implement assembly and positioned to move the implement assembly relative to the boom arm assembly when a piston of the second implement cylinder is extended or retracted, the second hydraulic implement cylinder being connected to the second electrohydraulic valve for activating extension and retraction of the piston of the second implement cylinder and the piston of the first implement cylinder, wherein the controller sends a series of shaking control signals to alternately extend and retract the first implement cylinder and the second implement cylinder to effect a shaking movement of the implement.

In accordance with a fourteen embodiment of the invention, the ninth embodiment is modified so that the implement is a loader bucket.

In a fifteenth embodiment in accordance with the present invention, a method for controlling movement of a boom arm assembly and an implement pivotally connected to the boom arm assembly having the steps of: (a) controlling movement of the boom arm assembly and the implement in a first operational mode using a controller that operates in the first operational mode and in a second operational mode, wherein movement control in the first operational mode effects smooth movements of the boom arm assembly and the implement in accordance with input signals received by the controller from control sensors; (b) switching the operation of the controller from the first operational mode to the second operational mode; (c) controlling movement of the boom arm assembly and the implement in the second operational mode using the controller, wherein movement control in the second operational mode effects shaking movement of the implement relative to the boom arm assembly in accordance with input signals received by the controller from one of the control sensors, wherein the shaking movement occurs about a pivotal connection between the boom arm assembly and the implement.

In accordance with a sixteenth embodiment of the invention, the fifteenth embodiment is modified so the one of the control sensors is a hand control sensor that generates first signals proportional to a displacement from a neutral position, and the controller receives the first signals from the hand control sensor, wherein the controller uses the first signals to control the shaking movement of the implement in one of a first shaking mode, a second shaking mode and a third shaking mode.

In accordance with a seventeenth embodiment of the invention, the sixteenth embodiment is modified so that in the first shaking mode, the controller controls the shaking movement of the implement so that movement in a dump direction is equal to movement in a curl direction.

In accordance with a eighteenth embodiment of the invention, the sixteenth embodiment is further modified so in the second shaking mode, the controller controls the shaking movement of the implement so that movement in a dump direction is greater than movement in a curl direction.

In accordance with a nineteenth embodiment of the invention, the sixteenth embodiment is further modified so in the third shaking mode, the controller controls the shaking movement of the implement so that movement in a curl direction is greater than movement in a dump direction.

Further objects, features and advantages of the present invention will become apparent from the Detailed Description of the Preferred Embodiments, which follows, when considered together with the attached drawings.

DETAILED DESCRIPTION OF THE PREFERRED EMBODIMENTS

The machine of the present invention is described with reference to FIGS. 1–4, wherein like numerals indicate like parts. The method of control of the shaking mechanism of the machine of the present invention is described with reference to FIG. 5. The machine embodiment in accordance with the present invention will be described first to facilitate an easy understanding of the method of shaking control.

Figure 1:
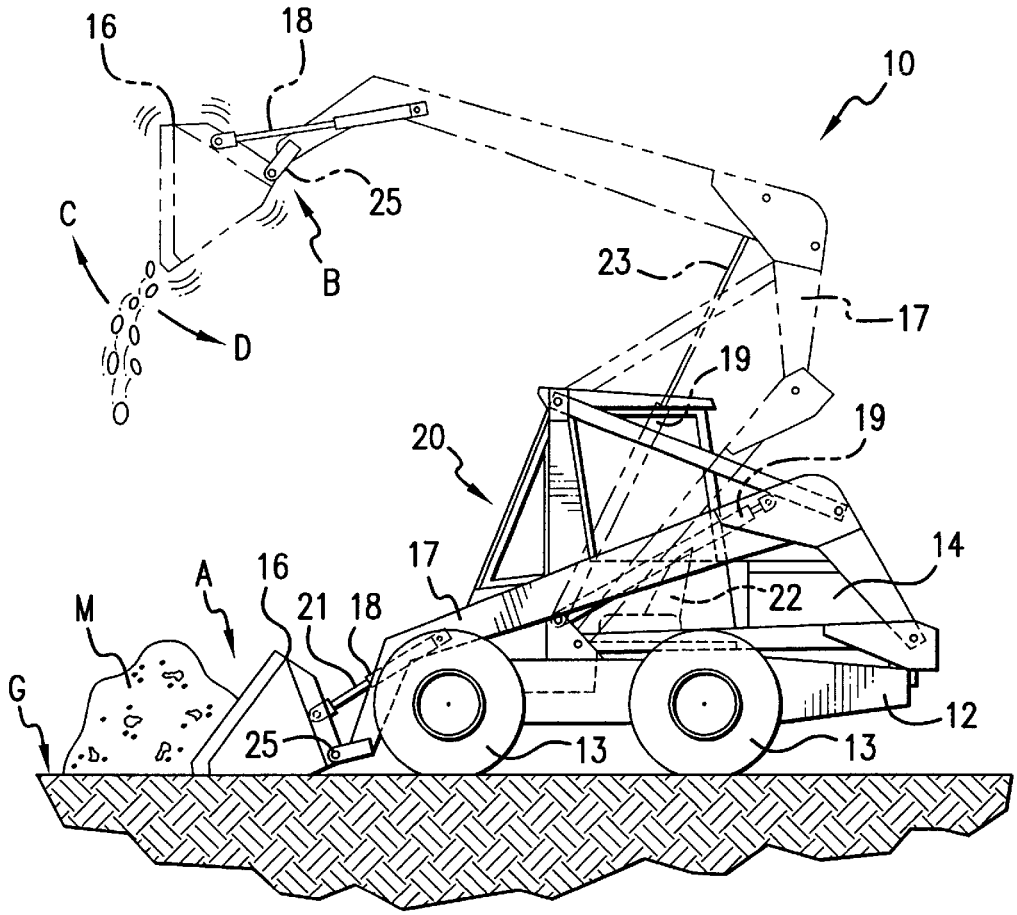
FIG. 1 is a schematic side perspective view of a work vehicle having a shaking mechanism in accordance with the present invention with the hydraulically activated movement of the boom assembly being shown in phantom.
Figure 3:
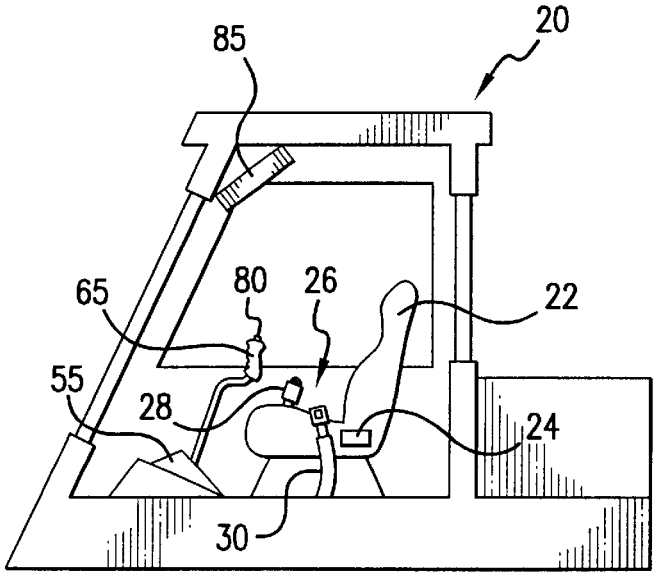
FIG. 3 is a schematic drawing of the interior of the cab compartment carried on the work vehicle.

The machine of the present invention shown in FIG. 1 is a compact work vehicle 10, such as a skid steer loader or other like work vehicle, that includes a cab compartment 20 on the vehicle. Typically, work vehicle 10 includes a body 12 that is mounted on four wheels 13 (only two shown) that are operably connected to a transmission. The transmission is powered by an engine disposed in engine housing 14 located on the body 12. One skilled in the art would realize that the work vehicle 10 could be a tracked vehicle, a vehicle mounted on rails, or could be a machine mounted to a stationary frame without departing from the scope of the present invention.

Work vehicle 10 includes a boom arm assembly 17 that is pivotally connected to the body 12 at one end, and that is pivotally connected at its opposite end to a work implement 16, such as a loader bucket, or other suitable tool. As shown in FIG. 1, boom arm assembly 17 can be raised and lowered between a lower position A and an upper position B (shown in phantom) through a range of motion using hydraulic power provided by a pair of hydraulic boom cylinders 19 of a hydraulic circuit 50 (shown in FIG. 2) so that the implement 16 can be used to perform its intended function. Implement 16 rotates about pivot connection 25 of the implement assembly (i.e., implement 16 and pivot connection 25).

In the exemplary illustration of FIG. 1, implement 16 is shown as a loader bucket and the work vehicle 10 is shown as a skid steer loader. One skilled in the art would realize that implement 16 could be practiced as a snow blade, other digging implement, or other suitable tool and the work vehicle 10 could be practiced as a tractor, bulldozer, or other, like vehicle, without departing from the spirit and scope of the present invention. Work vehicle 10 is shown digging into material M at position A, wherein the boom assembly 17 is in a lowered position. Work vehicle 10 is also shown dumping out the material at position B, wherein the boom assembly is somewhat extended and raised at position B. The present invention is directed to a shaking mechanism for shaking the implement 16, and optionally the boom arm assembly 17, as will be described below.

The shaking mechanism is constructed so as to operate to shake the implement 16, and in some cases the boom arm assembly 17 and the implement 16, when an operator in the cab compartment 20 activates the shaking mechanism by engaging a shaker mode activation switch 80 in the cab. In addition, the shaking mechanism is also constructed so as to operate to shake at least implement 16 in any position within the range of motion of the boom arm assembly 17 and implement 16. To achieve these features of the present invention, the shaking mechanism includes a hydraulic circuit 50 for moving at least implement 16, and in some instances boom arm assembly 17, in a pulsatile, shaking, or reverberating manner. The hydraulic circuit 50 is connected to be electronically controlled by electronic control circuit 90. Control circuit 90 generates and sends control signals to operate special electronically activated hydraulic cartridge valves of hydraulic circuit 50 to effect pulsation, shaking, or reverberation as will be described below.

Figure 2:
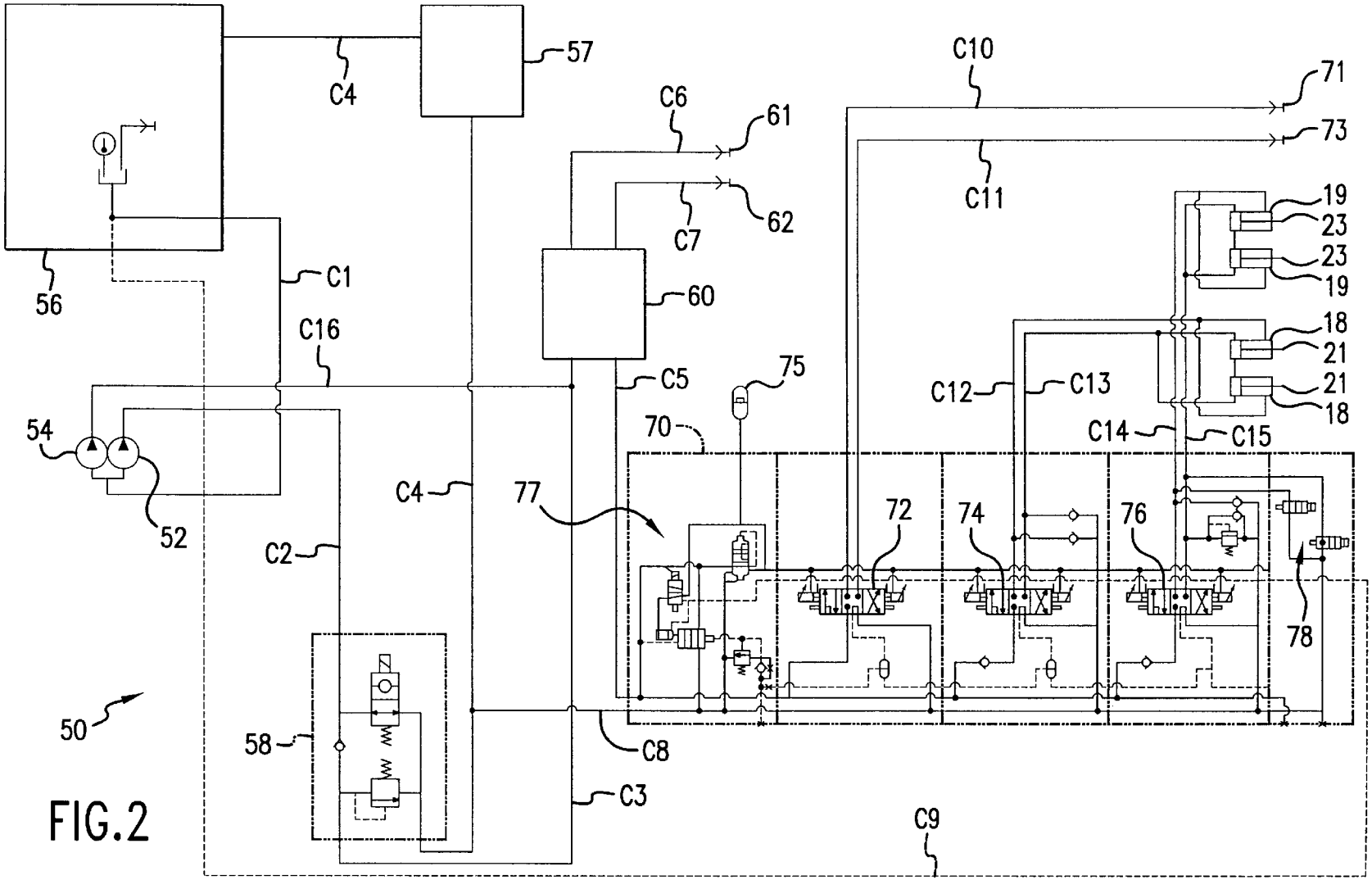
FIG. 2 is a schematic drawing of the hydraulic circuit component of the shaking mechanism that shakes the boom assembly and the implement.

The hydraulic circuit 50, as shown in FIG. 2, includes two hydraulic gear pumps 52, 54 connected to draw hydraulic fluid from hydraulic fluid reservoir 56 via hydraulic conduit C1 and to pump hydraulic fluid throughout hydraulic circuit 50. Preferably, pump 52 is a high flow pump and pump 54 is a low flow pump. High flow pump 52 pumps hydraulic fluid via hydraulic fluid conduit C2 to a diverter valve 58. Diverter valve 58 operates to divert hydraulic fluid flow to hydraulic conduit C3 or to hydraulic drain C4. Hydraulic fluid flowing through conduit C3 is used to activate auxiliary valve stack 60, such as would be used to operate an auxiliary hydraulic device (not shown) via hydraulic output conduit C6 and check valve 61, and hydraulic drain conduit C7 and check valve 62, and/or to activate implement valve stack 70 via hydraulic conduit C5. In the practice of the present invention, auxiliary valve stack 60, conduits C6, C7, and check valves 61, 62 are optional features that can be omitted without departing from the scope and spirit of the invention. In the case where valve stack 60, conduits C6, C7, and check valves 61, 62 are omitted, conduits C3 and C5 are constructed to be directly contiguous conduits.

In either case, whether hydraulic circuit 50 includes the optional structures or not, conduit C5 provides hydraulic fluid flow to implement valve stack 70. Implement valve stack 70 incorporates auxiliary valve 72, implement valve 74, boom valve 76, accumulator 75, inlet valve circuit 77, and float circuit 78. Accumulator 75 and inlet valve circuit 77 are connected so as to provide a pilot pressure when the work vehicle 10 is off. Float circuit 78 is provided to allow the boom arm assembly 17 to "float" in a conventional manner.

Each valve 72, 74, and 76 is a digital coil operated, spring return-to-center, hydraulic 4/3 cartridge valve, wherein each valve is electrically connected via the digital coil or coils to electronic control circuit 90. Each digital coil responds to activating digital electronic pulse signals with modulation generated by the controller 110 of control circuit 90, which gives these cartridge valves the capability to rapidly oscillate. Standard solenoid activated spool valves, in comparison, operate in response to electronic analog signals and do not have the capacity to rapidly oscillate as quickly as the digital coil operated cartridge valves can. Cartridge valves 72, 74, and 76 also share a common hydraulic drain conduit C9 that drains to reservoir 56. Furthermore, excess hydraulic fluid flow to the implement valve stack 70 can return to reservoir 56 via hydraulic fluid conduits C8 and C4.

Activation of auxiliary cartridge valve 72 serves to provide hydraulic fluid to hydraulic conduit CIO and check valve 71, which can be connected to provide hydraulic fluid for activating an auxiliary device such as an auger drill. Hydraulic fluid drains back from the auxiliary device via check valve 73 and hydraulic conduit C11 to auxiliary cartridge valve 72 before draining back to reservoir 56 via conduits C8 and C4. An oil filtration and cooling circuit 57 is connected along conduit C4 so as to filter and cool the hydraulic fluid returning to reservoir 56.

Activation of implement cartridge valve 74 serves to provide hydraulic fluid to hydraulic conduit C12 to activate hydraulic implement cylinders 18. Activation of implement cylinders 18 results in movement of pistons 21, thereby effecting rotational motion of implement 16 about its pivotal connection 25 to boom arm assembly 17. Hydraulic fluid drains back from implement cylinders 18 via hydraulic conduit C13 to implement cartridge valve 74 before draining back to reservoir 56 via conduits C8 and C4.

Activation of boom cartridge valve 76 serves to provide hydraulic fluid to hydraulic conduit C14 to activate hydraulic boom cylinders 19. Activation of boom cylinders 19 results in movement of pistons 23, thereby effecting motion of boom assembly 17 such as shown in FIG. 1. Hydraulic fluid drains back from implement cylinders 19 via hydraulic conduit C15 to boom cartridge valve 76 before draining back to reservoir 56 via conduits C8 and C4.

Hydraulic circuit 50 also includes low flow pump 54 connected to provide hydraulic fluid to conduit C3 via hydraulic conduit C16. Low flow pump 54 provides much of the hydraulic fluid flow needed to activate auxiliary stack 60 and implement valve stack 70; however, when much higher flows are needed high flow pump 52 is activated to provide the additional hydraulic flow.

Figure 4:
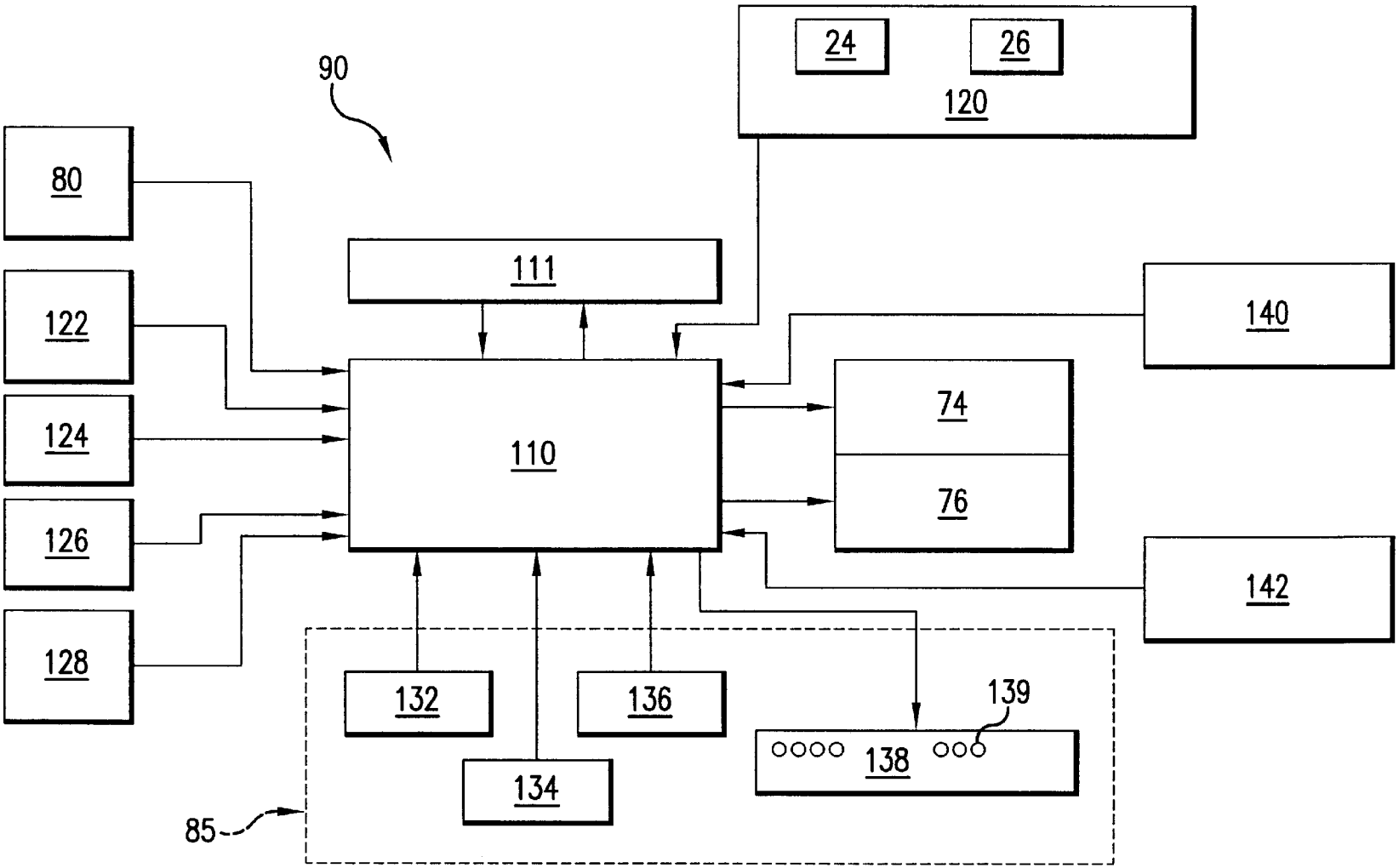
FIG. 4 is a schematic drawing of the electronic control circuit connected to control operation of the hydraulic circuit for a work vehicle in accordance with the present invention.

Next, the electronic control circuit 90 will be described. FIG. 4 illustrates electrical connections between the various components of the electronic control circuit 90 in accordance with the present invention. Electronic control circuit 90 is carried by the work vehicle 10 and includes an on board controlling microprocessor (also referred to as the "controller") 110 connected to exchange data with a memory storage device 111. Preferably, memory storage device 111 is a non-volatile memory that stores the neutral positions of the operator's manual controls, such as foot control pedals 55 and the hand controls 65, and other data as described below. Although controller 110 and memory storage device 111 are preferably separate structures, controller 110 can be constructed to incorporate the memory storage device without departing from the scope of the invention.

Controller 110 is connected to receive electronic signal inputs from the following devices: operator "seat belt switch and seat switch" circuit 120, right hand stick implement control and position sensor 122, left hand stick boom control and position sensor 124, right foot pedal implement control and position sensor 126, left foot pedal boom control and position sensor 128, hand/foot controls selector switch 132, vehicle tilt sensor 134, implement leveler mode selection switch 136, boom position sensor 140, implement angle position sensor 142, and shaker mode activation switch 80. Although many different types of controllers are suitable for use as the controller 110 in system 90 of the present invention, microcontroller C167CR manufactured by Infineon Technologies AG (Germany) is particularly well suited for use in the present system environment.

Controller 110 is connected to receive an enabling signal from "seat belt switch and seat switch" circuit 120 that incorporates a seat switch 24 and a seat belt switch 26 as part of seat 22, such as disclosed in U.S. Pat. No. 4,871,044 to Strosser et al, which is incorporated herein by reference for all it discloses. Seat belt switch 26 includes male seat belt fastener 28 and female seat belt fastener 30. Specifically, controller 110 is prevented from generating and/or sending activation control signals to activate digital coil controlled hydraulic cartridge valves 74 and 76 for activating hydraulic cylinders 18 and 19, respectively, until the controller has received the enabling signal from the "seat belt switch and seat switch" circuit 120.

Control and position sensors 122, 124, 126, and 128 respectively sense the position of a right hand manual control 65, a left hand manual control (not shown), a right foot pedal manual control 55 and a left foot pedal manual control (not shown), and each sensor sends a respective data signal to controller 110 indicating the position and rate of change of position of the corresponding manual control from its neutral position. Controller 110 processes this information and generates a first set of digitally modulated control signals that are sent to the electrical digital coils of hydraulic cartridge valves 74 and 76 to operate hydraulic cylinders 18 and 19 in proportion to the deviation of right and left manual controls from a neutral position. In other words, the rate of change of position of implement 16 and boom arm assembly 17 is determined by the position of the right and left manual controls, respectively, be they hand manual controls 65 or foot pedal manual controls 55.

Controller 110 is connected to receive a selection signal from hand/foot control selector switch 132, wherein the selection signal is used to determine whether controller 110 will be enabled to process manual control input signals received only from the hand controls 65 or only from the foot pedal controls 55. In other words, electronic control circuit 90 utilizes signal input from either hand control sensors 122, 124 or foot pedal sensors 126, 128, but at any one time circuit 90 can not utilize signal input from all four sensors 122, 124, 126, 128. Circuit 90 is constructed to utilize signal inputs from only one pair of these control and position sensors at a time, being either right and left hand control and position sensors 122, 124 or right and left foot pedal control and position sensors 126, 128, and to generate and send control signals to the digital coils of cartridge valves 74 and 76 in response to receiving the control and position sensor signal input.

Controller 110 may also be connected to receive data signal input from other sensors such as vehicle tilt sensor 134, boom position sensor 140, and implement angle position sensor 142. Controller 110 utilizes these position data signals for various implement 16 and boom assembly 17 automatic positioning functions as may be programmed into the controller. For example, controller 110 can be connected to receive a mode selection signal from implement leveler mode selection switch 136. The mode selection signal would instruct controller 110 to operate in one of several implement self-leveling modes programmed into the controller. Some of the implement self-leveling modes might require data signal input from sensors 134, 140, and/or 142 to operate properly.

In accordance with the present invention, controller 110 is preprogrammed to generate digitally modulated output control signals to selectively activate the digital coils of cartridge valves 72, 74 and 76 to effect smooth hydraulic flow or pulsatile, shaking, or reverberating hydraulic fluid flow upon command. More particularly, the digital coils of cartridge valve 74 and cartridge valve 76 are controlled by a first set of control signals generated by controller 110 so as to effect smooth hydraulic fluid flow to hydraulic implement cylinders 18 and hydraulic boom assembly cylinders 19 when the controller 110 is operating in a first operational mode, corresponding to the normal operation of the implement and the boom assembly. However, upon receiving an activating command signal, controller 110 switches its mode of operation to a second operational mode corresponding to controlling cartridge valves 74 and 76 to effect pulsatile, shaking or reverberating hydraulic fluid flow so that at least the implement 16, and in some embodiments boom arm assembly 17, is moved in a pulsatile, shaking or reverberating manner.

The activating command signal instructing controller 110 to selectively control cartridge valve 74, and/or possibly cartridge valve 76, to effect pulsatile, shaking or reverberating hydraulic fluid flow, originates from shaking mode activation switch 80. Preferably, shaking mode activation switch 80 is located on the right hand manual control 65 as shown in FIG. 2, and is connected to send the activating command signal to controller 110. Simply stated, as long as switch 80 is depressed, switch 80 sends a shaking mode activating signal to controller 110, and the controller responds by generating a second set of digital control signals (also known as the "shaking signals") modulated in accordance with the program of the controller 110. The shaking signals are sent to the electronic digital coils of hydraulic cartridge valve 74, and/or possibly hydraulic cartridge valve 76, with a modulation that operates hydraulic cylinders 18, and/or possibly hydraulic cylinders 19, in a pulsatile, shaking or reverberating manner, hereafter also referred to as operating in the "implement shaking mode." When the hydraulic cylinders 18, and/or possibly hydraulic cylinders 19, are operated in the implement shaking mode, the pistons 21 and 23, respectively, move alternately between extension and retraction in short, rapid, pulsatile, shaking or reverberating movements to effect cyclic pulsatile, shaking or reverberating movement of the implement 16 and/or boom assembly 17.

When in the implement shaking mode of the preferred embodiment of the present invention, controller 110 sends the shaking signals only to cartridge valve 74 so that only implement 16 is shaked. However, one of ordinary skill in the art would appreciate that, when in the implement shaking mode, controller 110 could be programmed to send the shaking signals only to cartridge valve 76 so that only the boom assembly 17 is directly shaken without departing from the spirit and scope of the present invention. In this case, implement 16 gets shaken along with the boom arm assembly 17 because it is carried by the boom arm assembly 17. One of ordinary skill in the art would also appreciate that, when in the implement shaking mode, controller 110 could be programmed to send the shaking signals to both cartridge valve 74 and cartridge valve 76 simultaneously, thereby directly shaking both implement 16 and boom assembly 17 without departing from the spirit and scope of the present invention.

Controller 110 is also connected to send output signals to indicators 139 of a status display 138 of a Total Control System display 85, such as might be located in the cab compartment 20 of the work vehicle 10. Indicators 139 would indicate various conditions of the work vehicle 10, such as the condition of the "seat belt switch and seat switch" circuit 120, any implement self-leveling mode in effect, and whether hand or foot pedal manual controls are enabled.

As described above, the work vehicle 10 in accordance with the present invention has an implement shaking mechanism that includes electronic control circuit 90 that is operable in an implement shaking mode activated by a shaking mode switch 80. When control circuit 90 is operating in the implement shaking mode, it generates modulated digital shaking signals that are sent to the digital coils of cartridge valve 74, and/or possibly cartridge valve 76, thereby operating the activated cartridge valve or valves to effect pulsatile, shaking, or reverberating movement of each valve's respective piston. Each piston, moving to extend and retract in a rapid pulsatile, shaking, or reverberating manner, likewise moves at least the implement 16 in a shaking manner. In some embodiments, both the implement 16 and the boom assembly 17 could be shaken together.

The most effective and efficient shaking mechanism embodiment in accordance with the present invention is the shaking mechanism embodiment programmed to shake the implement 16 and not the boom arm assembly 17. This is because the implement 16 is smaller than the boom arm assembly 17 and is relatively easy to oscillate about pivot connection 25. The method of controlling the shaking mechanism, in accordance with this preferred implement shaking embodiment of the present invention, is diagramed in the flow chart shown in FIG. 5. However, the method outlined in FIG. 5 could be modified to shake the boom arm assembly 17 or both the boom arm assembly and the implement 16.

Figure 5:
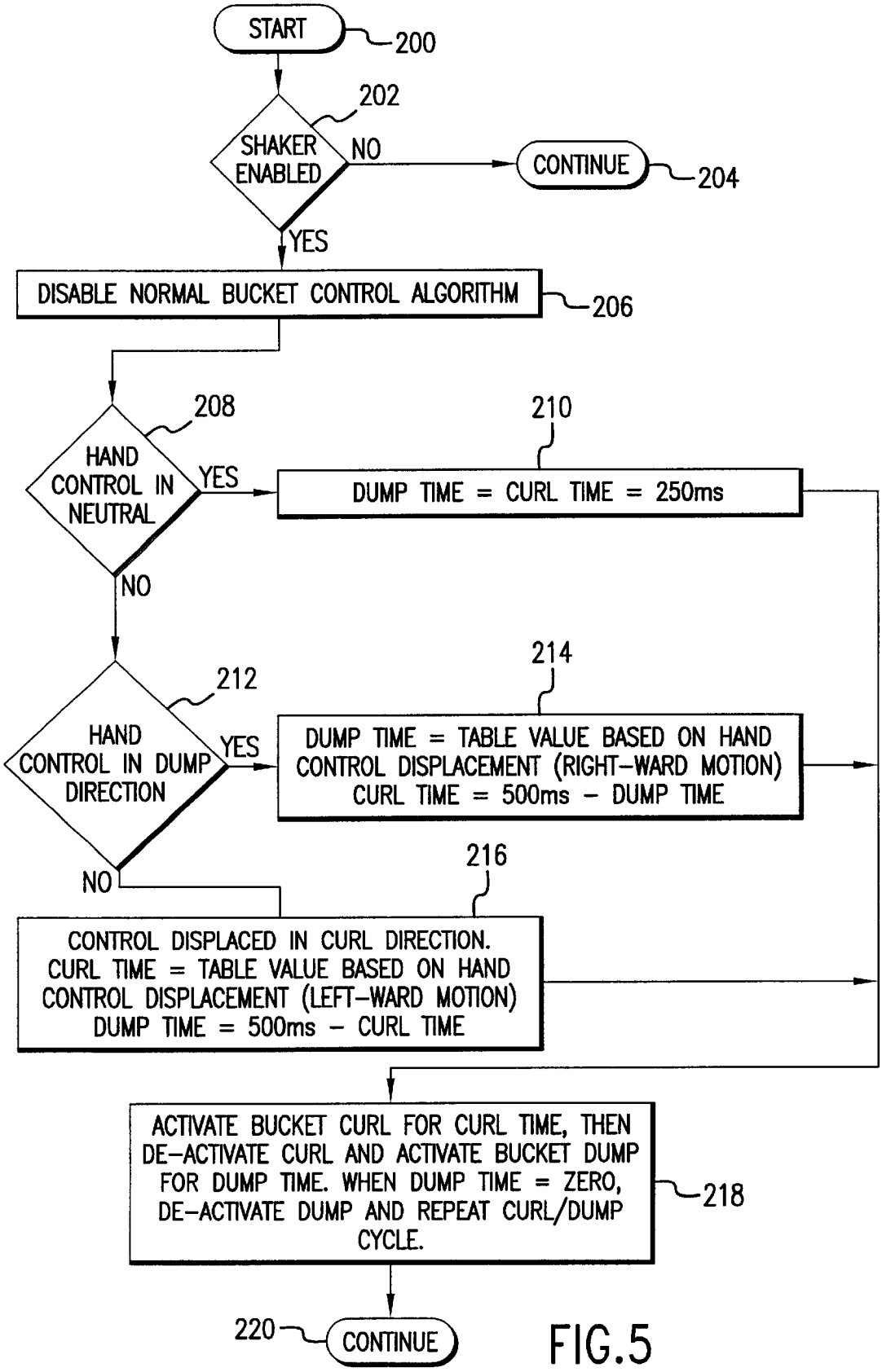
FIG. 5 is a flow chart of operative steps in the method of control of the shaking mechanism of the present invention.

Referring to FIG. 5, the start condition 200 is the normal operating condition, or first operational mode, of the shaking mechanism. In the first operational mode, controller 110 generates and sends a first series of digital signals to cartridge valves 74 and 75 modulated to effect smooth movements of the boom arm assembly 17 and implement 16 in accordance with input signals from hand control sensors 122, 124 or foot pedal control sensors 126, 128, and any other enabled input signals for effecting boom arm assembly and implement movement control (i.e., signal input from vehicle tilt sensor 134, boom position sensor 140, implement angle position sensor 142, and etc.).

In the next step 202, controller 110 determines if the shaker mechanism should be enabled to operate in the second operational mode, also referred to as the implement shaking mode. In the implement shaking mode, controller 110 generates and sends a series of second digitally modulated shaking control signals to at least the digital coils of cartridge valve 74 so as to effect rapid pulsating, shaking, or reverberating movements of implement 16. In the shaker mechanism enabling step 202, the shaking mode switch 80 either is engaged or not engaged. When switch 80 is engaged, switch 80 sends a command signal to controller 110 that directs the controller to generate and send the shaking control signals, thereby enabling or activating the implement shaking mode and the method moves to step 206. When switch 80 is not engaged, no command signal is sent from switch 80 to controller 110. Under this condition, the method has moved to step 204 wherein controller 110 continues to operate the shaking mechanism in the first operational mode.

When the method algorithm moves to step 206, controller 110 operates to disable the normal implement control algorithm, being the first operational mode, as the controller operates to enable the control subroutine of the second operational mode. In the second operational mode, the method moves from step 206 to step 208.

In step 208, controller 110 determines whether the hand controls 65 or the foot pedal controls 55 are in the neutral position depending upon which set of manual controls have been selected for and enabled by the hand/foot controls selector switch 132, because only one set of manual controls is enabled at any one time. In the case where the hand controls 65 are enabled, controller 110 determines from signals provided by the right hand stick implement control and position sensor 122 if the right hand control 65 is in the neutral position. When this condition is present, the method moves to step 210.

In step 210, the program of the controller 110 instructs the controller to prepare to generate and send modulated digital signals to the digital coils of cartridge valve 74 so that the implement 16 will shake in a first shaking mode. In the first shaking mode, the dump time and the curl time are set to be equal (e.g., dump time=curl time=250 msec). In this context, implement 16 is said to be moving in the "dump direction" D when it is being rotated towards the ground G as indicated in FIG. 1. Also in this context, implement 16 is said to be moving in the "curl direction" C when it is being rotated away from the ground G as indicated in FIG. 1. Thus, the "dump time" is defined as the length of time that the implement 16 is moved in the dump direction and the "curl time" is the length of time implement 16 is moved in the curl direction. So, when the enabled right hand manual control 65 is in the neutral position, the method is in step 210 and controller 110 operates the shaking mechanism to shake implement 16 with equal oscillations in the dump direction and the curl direction. Consequently, the implement 16 will shake around some neutral position.

However, when right hand manual control 65 is not in the neutral position, the method moves from step 208 to step 212. In step 212, the controller receives signals provided by the right hand stick implement control and position sensor 122 and determines if the right hand manual control 65 is in a right or "dump" position. When this condition is present, the method moves to step 214. When this condition is not met, the right hand manual control 65 must be in a left or "curl" position and the method moves to step 216.

In step 214, the program of the controller 110 instructs the controller to prepare to generate and send modulated digital signals to the digital coils of cartridge valve 74 so that the implement 16 will shake in a second shaking mode. In the second shaking mode, the dump time is calculated from a table value that is based upon the dump position of the right hand manual control 65, which is the right-ward displacement of the right hand manual control from the neutral position. The curl time follows from the following equation: curl time=500 msec-dump time.

In step 216, the program of the controller 110 instructs the controller to prepare to generate and send modulated digital signals to the digital coils of cartridge valve 74 so that the implement 16 will shake in a third shaking mode. In the third shaking mode, the dump time is calculated from a table value that is based upon the curl position of the right hand manual control 65, which is the left-ward displacement of the right hand manual control from the neutral position. The dump time follows from the following equation: dump time=500 msec-curl time.

The method moves to step 218 from any one of steps 210, 214 and 216. In step 218, controller 110 operates to generate and send the appropriately modulated digital signals to the digital coils of cartridge valve 74 so that the implement 16 will shake in one of the first shaking mode, the second shaking mode or the third shaking mode depending upon whether the immediately preceding step was step 210, 214 or 216, respectively. In other words, controller 110 will activate the implement cylinders 18 to curl the implement for the duration of the curl time, then de-activate the curl and activate movement in the dump direction for the duration of the dump time. When the dump time period has expired, the dump is deactivated and the curl repeats. This curl-dump cycle repeats for as long as the operator of the work vehicle engages shaker mode activation switch 80. When the operator disengages switch 80, the method moves to step 220, which is returning to the first operational mode, being the condition of the shaking mechanism in steps 200 and 204.

It is noted that when the shaking mechanism is operating in the first shaking mode, the implement 16 shakes about some neutral position, there being no net rotation or drift of the implement. When operating in the second shaking mode, the shaking mechanism tends to produce a net rotation of implement 16 in the dump direction. Likewise, when operating in the third shaking mode, the shaking mechanism tends to produce a net rotation of implement 16 in the curl direction. One specific advantage of the second shaking mode is that it dumps as it shakes, thereby efficiently enhancing removal of any residual sticky material from implement 16.

Although the method of controlling the shaking mechanism has been described using the right hand manual control 65, the method can be practiced when the foot pedal manual controls 55 are enabled and the hand manual controls 65 are disabled. In this case, controller 110 receives and uses signals from the right foot pedal stick implement control and position sensor 126 to determine if the right foot pedal manual control 55 is in the neutral position (step 208). When this condition is present, the method moves to step 210 and the shaking mechanism is directed by the remaining steps in the method to operate in the first shaking mode. Likewise, controller 110 can use the signals from the right foot pedal control and position sensor 126 to determiner if the right foot pedal manual control 55 is displaced in a right-ward displacement from the neutral position, thereby activating the second shaking mode of step 214, or is displaced in a left-ward displacement from the neutral position, thereby activating the third shaking mode of step 216. Thus, the method of controlling the shaking mechanism proceeds in a like manner as described above when the hand manual controls 65 are enabled with the foot pedal manual controls 55 disabled as it does when the foot pedal manual controls 55 are enabled with the hand manual controls 65 disabled.

While the present invention has been described with reference to certain preferred embodiments, one of ordinary skill in the art will recognize that additions, deletions, substitutions, modifications and improvements can be made while remaining within the spirit and scope of the present invention as defined by the appended claims.

What is claimed is:

1. A work vehicle having an implement, comprising:

a frame;

a boom arm assembly connected at one end to the frame;

an implement assembly pivotally connected to another end of the boom arm assembly and including the implement;

a first hydraulic implement cylinder connected to the implement assembly and positioned to pivotally rotate the implement relative to the boom arm assembly when a piston of the first implement cylinder is extended or retracted, the first hydraulic implement cylinder being connected to a first electrohydraulic valve for activating extension and retraction of the piston of the first implement cylinder; and a controller connected to send control signals to activate the first electrohydraulic valve, wherein the controller sends a series of shaking control signals to alternately extend and retract the first implement cylinder to effect a shaking movement of the implement.

2. A work vehicle as recited in claim 1, wherein the controller operates in a first operational mode and in a second operational mode, wherein the controller generates and sends a first series of control signals to the first electrohydraulic valve when operating in the first operational mode and the controller generates and sends the series of shaking control signals when operating in the second operational mode.

3. A work vehicle as recited in claim 2, further comprising a shaking mode activation switch connected to send a command signal to the controller, wherein when the activation switch is engaged the activation switch sends the command signal to the controller and the controller operates in the second mode as long as the controller receives the command signal from the activation switch.

4. A work vehicle as recited in claim 1, wherein the first electrohydraulic valve is a cartridge valve having at least one digital coil, and the at least one digital coil is connected to receive control signals from the controller.

5. A work vehicle as recited in claim 1, further comprising a second hydraulic implement cylinder connected to the implement assembly and positioned to pivotally rotate the implement relative to the boom arm assembly when a piston of the second implement cylinder is extended or retracted, the second hydraulic implement cylinder being connected to the first electrohydraulic valve for activating extension and retraction of the piston of the second implement cylinder and the piston of the first implement cylinder, wherein the controller sends a series of shaking control signals to alternately extend and retract the first implement cylinder and the second implement cylinder to effect a shaking movement of the implement.

6. A work vehicle as recite in claim 1, further comprising a second hydraulic boom cylinder connected to the boom arm assembly and positioned to move the boom arm assembly relative to the frame of the work vehicle when a piston of the second boom cylinder is extended or retracted, the second hydraulic boom cylinder being connected to a second electrohydraulic valve for activating extension and retraction of the piston of the second boom cylinder, and the controller is connected to send control signals to activate the second electrohydraulic valve, wherein the controller sends control signals to effect movement of the boom assembly.

7. A work vehicle as recited in claim 6, wherein the second electrohydraulic valve is a cartridge valve having at least one digital coil, and the at least one digital coil is connected to receive control signals from the controller.

8. A work vehicle as recited in claim 1, wherein the implement is a loader bucket.

9. A work vehicle having an implement, comprising:

a frame;

a boom arm assembly connected at one end to the frame;

an implement assembly pivotally connected to another end of the boom arm assembly and including the implement;

a first hydraulic boom cylinder connected to the boom arm assembly and positioned to move the boom arm assembly relative to the frame of the work vehicle when a piston of the first boom cylinder is extended or retracted, the first hydraulic boom cylinder being connected to a first electrohydraulic valve for activating extension and retraction of the piston of the first boom cylinder;

a first hydraulic implement cylinder connected to the implement assembly and positioned to pivotally rotate the implement relative to the boom arm assembly when a piston of the first implement cylinder is extended or retracted, the first hydraulic implement cylinder being connected to a second electrohydraulic valve for activating extension and retraction of the piston of the first implement cylinder; and a controller connected to send control signals to activate the first electrohydraulic valve and the second electrohydraulic valve, wherein the controller sends a series of shaking control signals to alternately extend and retract one of the first implement cylinder and the first boom cylinder to effect a shaking movement of either the implement or the boom arm assembly and the implement.

10. A work vehicle as recited in claim 9, wherein the controller operates in a first operational mode and in a second operational mode, wherein the controller generates and sends a first series of control signals to the first electrohydraulic valve and the second electrohydraulic valve when operating in the first operational mode and the controller generates and sends the series of shaking control signals when operating in the second operational mode.

11. A work vehicle as recited in claim 10, further comprising a shaking mode activation switch connected to send a command signal to the controller, wherein when the activation switch is engaged the activation switch sends the command signal to the controller and the controller operates in the second mode so long as the controller receives the command signal from the activation switch.

12. A work vehicle as recited in claim 9, wherein each of the first electrohydraulic valve and the second electrohydraulic valve is a cartridge valve having at least one digital coil, and the at least one digital coil is connected to receive control signals from the controller.

13. A work vehicle as recited in claim 9, further comprising a second hydraulic implement cylinder connected to the implement assembly and positioned to move the implement assembly relative to the boom arm assembly when a piston of the second implement cylinder is extended or retracted, the second hydraulic implement cylinder being connected to the second electrohydraulic valve for activating extension and retraction of the piston of the second implement cylinder and the piston of the first implement cylinder, wherein the controller sends a series of shaking control signals to alternately extend and retract the first implement cylinder and the second implement cylinder to effect a shaking movement of the implement.

14. A work vehicle as recited in claim 9, wherein the implement is a loader bucket.

15. A method for controlling movement of a boom arm assembly and an implement pivotally connected to the boom arm assembly, the method comprising the steps of:

controlling movement of the boom arm assembly and the implement in a first operational mode using a controller that operates in the first operational mode and in a second operational mode, wherein movement control in the first operational mode effects smooth movements of the boom arm assembly and the implement in accordance with input signals received by the controller from control sensors;

switching the operation of the controller from the first operational mode to the second operational mode;

controlling movement of the boom arm assembly and the implement in the second operational mode using the controller, wherein movement control in the second operational mode effects shaking movement of the implement relative to the boom arm assembly in accordance with input signals received by the controller from one of the control sensors, wherein the shaking movement occurs about a pivotal connection between the boom arm assembly and the implement.

16. A method as recited in claim 15, wherein the one of the control sensors is a hand control sensor that generates first signals proportional to a displacement from a neutral position, and the controller receives the first signals from the hand control sensor, wherein the controller uses the first signals to control the shaking movement of the implement in one of a first shaking mode, a second shaking mode and a third shaking mode.

17. A method as recited in claim 16, wherein in the first shaking mode, the controller controls the shaking movement of the implement so that movement in a dump direction is equal to movement in a curl direction.

18. A method as recited in claim 16, wherein in the second shaking mode, the controller controls the shaking movement of the implement so that movement in a dump direction is greater than movement in a curl direction.

19. A method as recited in claim 16, wherein in the third shaking mode, the controller controls the shaking movement of the implement so that movement in a curl direction is greater than movement in a dump direction.

* * * * *